US007546930B2

(12) United States Patent
Banik et al.

(10) Patent No.: US 7,546,930 B2
(45) Date of Patent: Jun. 16, 2009

(54) HERMETIC WIPE CONTAINER

(75) Inventors: Joachim Banik, Oconomowoc, WI (US); Jon C. Alexander, Kewaskum, WI (US); Tarry P. Zielinski, Sussex, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 689 days.

(21) Appl. No.: 10/916,019

(22) Filed: Aug. 11, 2004

(65) Prior Publication Data

US 2005/0067313 A1 Mar. 31, 2005

Related U.S. Application Data

(63) Continuation-in-part of application No. 10/776,017, filed on Feb. 10, 2004, which is a continuation-in-part of application No. 10/229,913, filed on Aug. 28, 2002, now abandoned.

(51) Int. Cl.
*B65D 51/18* (2006.01)
*B65D 73/00* (2006.01)
*B65D 83/08* (2006.01)

(52) U.S. Cl. ..... 220/254.3; 206/494; 206/233; 220/254.7

(58) Field of Classification Search ..... 220/62.21, 220/254.3, 254.1, 495.03, 495.02, 495.05, 220/495.06, 495.08, 495.11, 254.7, 258.1, 220/326; 383/33, 210.1, 66; 206/494, 233
See application file for complete search history.

(56) References Cited

U.S. PATENT DOCUMENTS 755,085 A 3/1904 Viano
2,173,288 A 9/1939 Shapiro
2,520,335 A 8/1950 Piazze
2,614,727 A 10/1952 Robinson
3,052,371 A * 9/1962 Bemmelen ..... 220/530
3,696,962 A 10/1972 Fehres et al.
3,819,043 A 6/1974 Harrison
3,836,044 A 9/1974 Tilp et al.
3,967,756 A 7/1976 Barish
3,979,020 A 9/1976 Braber et al.

(Continued)

FOREIGN PATENT DOCUMENTS

CH 380299 9/1964

(Continued)

OTHER PUBLICATIONS

Promotional materials for the "Not-A Bottle" container system; Rocky Mountain Patents, LLC; printed from website http://www.rockybusiness.com/brochure.pdf; Oct. 25, 2006; 2 pages.

*Primary Examiner*—Anthony D Stashick
*Assistant Examiner*—Niki M Eloshway
(74) *Attorney, Agent, or Firm*—Foley & Lardner LLP

(57) ABSTRACT

A hermetic storage system for storing wipes is provided. The hermetic storage system may include a flexible container, a first member, a second member, and a third member configured for holding the wipes. The flexible container is disposed between the first member and the second member. The third member is releasably coupled to the second member and covers an aperture defined by the second member. The hermetic storage system is configured to provide a hermetic seal when the third member is releasably engaged with the second member.

48 Claims, 7 Drawing Sheets

U.S. PATENT DOCUMENTS

| | | | | | |
|---|---|---|---|---|---|
| 3,986,479 | A | | 10/1976 | Bonk | |
| 4,166,548 | A | | 9/1979 | Crisci | |
| 4,185,754 | A | * | 1/1980 | Julius | 221/63 |
| 4,298,134 | A | * | 11/1981 | Lewis, Jr. | 220/792 |
| 4,347,943 | A | | 9/1982 | Hackwell et al. | |
| 4,454,889 | A | | 6/1984 | Contreras, Sr. | |
| 4,471,880 | A | | 9/1984 | Taylor et al. | |
| 4,526,291 | A | | 7/1985 | Margulies | |
| 4,534,491 | A | | 8/1985 | Norton et al. | |
| 4,535,912 | A | | 8/1985 | Bonk | |
| 4,553,665 | A | | 11/1985 | Weick et al. | |
| 4,586,519 | A | | 5/1986 | Seidler et al. | |
| 4,632,272 | A | | 12/1986 | Berenfield et al. | |
| 4,700,867 | A | * | 10/1987 | Dutt et al. | 220/495.05 |
| 4,756,140 | A | | 7/1988 | Gannon | |
| 4,768,668 | A | | 9/1988 | Van Den Brink | |
| 4,790,436 | A | | 12/1988 | Nakamura | |
| 4,893,726 | A | * | 1/1990 | Vesborg | 220/495.01 |
| 4,934,554 | A | | 6/1990 | Edwards | |
| 4,971,220 | A | | 11/1990 | Kaufman et al. | |
| 5,050,737 | A | | 9/1991 | Joslyn et al. | |
| 5,139,165 | A | | 8/1992 | Hara | |
| 5,257,865 | A | | 11/1993 | Tani | |
| 5,366,104 | A | | 11/1994 | Armstrong | |
| 5,379,897 | A | | 1/1995 | Muckenfuhs et al. | |
| 5,425,469 | A | * | 6/1995 | Freedland | 220/495.11 |
| 5,431,177 | A | | 7/1995 | Kecman | |
| 5,460,289 | A | * | 10/1995 | Gemmell | 220/495.02 |
| 5,476,187 | A | * | 12/1995 | Marisco | 220/495.08 |
| 5,515,875 | A | | 5/1996 | Acker et al. | |
| 5,520,303 | A | * | 5/1996 | Bernstein et al. | 220/495.08 |
| 5,531,325 | A | | 7/1996 | Deflander et al. | |
| 5,533,621 | A | | 7/1996 | Schoal, Jr. | |
| 5,549,213 | A | | 8/1996 | Robbins, III et al. | |
| 5,647,506 | A | | 7/1997 | Julius | |
| 5,662,238 | A | * | 9/1997 | Sarno | 220/495.11 |
| 5,699,912 | A | | 12/1997 | Ishikawa et al. | |
| 5,704,471 | A | * | 1/1998 | Yamada | 206/207 |
| 5,803,300 | A | * | 9/1998 | DeMars | 220/495.11 |
| 5,842,486 | A | | 12/1998 | Davis et al. | |
| 5,855,544 | A | | 1/1999 | Buchanan | |
| 5,860,742 | A | | 1/1999 | Faircloth, Jr. | |
| 5,938,069 | A | | 8/1999 | Macchia | |
| 5,992,679 | A | | 11/1999 | Porchia et al. | |
| 6,032,827 | A | | 3/2000 | Zettle et al. | |
| 6,135,277 | A | | 10/2000 | Armstrong | |
| 6,168,044 | B1 | | 1/2001 | Zettle et al. | |
| 6,199,559 | B1 | | 3/2001 | Nikolaus et al. | |
| 6,213,300 | B1 | | 4/2001 | Flaig et al. | |
| 6,216,907 | B1 | * | 4/2001 | Morneau | 220/495.05 |
| 6,269,969 | B1 | | 8/2001 | Huang et al. | |
| 6,309,105 | B1 | | 10/2001 | Palumbo | |
| 6,543,640 | B2 | | 4/2003 | Russo | |
| 6,578,731 | B1 | | 6/2003 | Lewis et al. | |
| 6,619,498 | B2 | | 9/2003 | von Holdt, Jr. | |
| 6,651,845 | B1 | | 11/2003 | Schroeder | |
| 6,761,279 | B1 | * | 7/2004 | Martin et al. | 220/258.2 |
| 6,772,904 | B1 | * | 8/2004 | Gilliam et al. | 220/836 |
| 2002/0148846 | A1 | | 10/2002 | Luburic | |
| 2005/0207680 | A1 | * | 9/2005 | Schumacher et al. | 383/66 |

FOREIGN PATENT DOCUMENTS

| | | |
|---|---|---|
| EP | 0919156 | 6/1999 |
| FR | 2 576 496 | 8/1986 |
| GB | 599452 | 3/1948 |
| WO | WO 83/02051 | 6/1983 |
| WO | WO 98/36985 | 8/1998 |
| WO | WO 01/32826 | 5/2001 |
| WO | WO 01/38187 | 5/2001 |
| WO | WO 01/38188 | 5/2001 |
| WO | WO 01/38189 | 5/2001 |
| WO | WO 01/51378 | 7/2001 |
| WO | WO 01/74687 | 10/2001 |
| WO | WO 01/85551 | 11/2001 |
| WO | WO 01/89354 | 11/2001 |
| WO | WO 02/14172 | 2/2002 |

* cited by examiner

HERMETIC WIPE CONTAINER

CROSS REFERENCE TO RELATED PATENT APPLICATIONS

This application is a continuation-in-part of prior application Ser. No. 10/776,017 filed Feb. 10, 2004, which is a continuation-in-part of prior application Ser. No. 10/229,913 filed Aug. 28, 2002.

BACKGROUND

The present application relates to a container configured for holding wipes and, more particularly, to a hermetic storage system for holding wipes at least partially saturated with a liquid solution in a hermetically sealed environment.

Conventional wipe container systems exist for holding both dry and wet wipes. The wipes may be used as baby wipes, household sanitizing wipes, moisturizing wipes, personal cleansing wipes, and wipes for other general purposes. Wipe container systems provide the consumer with an efficient and convenient way to change a baby's diaper, clean up spills, sanitize surfaces, and to address any other situation normally requiring a cloth and cleaning solution.

Traditional wipe container systems usually include a container for storing wipes and a platform or lid which is often attached to the container. Generally the lid can be positioned in an open position to allow access to the wipes, or the lid may be placed in a closed position relative to the container to provide an enclosed environment for the wipes. The wipe container systems commonly include a latch or other mechanism to maintain the lid in a closed position. The wipes are placed within the container, where they can be accessed by either lifting the lid or removed through a hole within the lid. Conventional wipe container systems are often configured such that they can be refilled rather than replaced, minimizing the amount of refuse produced.

Traditional wipe container systems commonly use liquid impregnated wipes, which are a combination of a cloth or other absorbent carrier and a substance such as a cleansing solution. One advantage of an integrated wipe/solution system is the elimination of the need to purchase and store both dry cloths and cleansing solutions. Other advantages include avoiding airborne or other hazards associated with spraying or applying a cleaner, avoiding mixing and measuring of cleaning solutions, and removing the need to clean a cloth after use. However, traditional wipe container systems do not provide a hermetic seal to prevent evaporation and contamination of the contents. As a result, the impregnated wipes deteriorate in quality due to evaporation during storage and become undesirable for use or sale.

The design of many conventional wipe container systems primarily focuses on allowing the consumer to easily and efficiently open the container and remove successive wipes using only one hand. However, these designs are often problematic in that they provide an ineffective seal when the lid is closed thereby magnifying evaporation or contamination of the wipes. Some manufacturers have attempted to overcome this problem by using a seal with an overlapping design wherein a section of the lid overlaps a section of the container when the lid is closed. In many cases this design is not continuous around the entire connection between the lid and container, resulting in a less effective seal. Containers which include multiple lids or openings utilizing these less effective seal designs only compound the potential evaporation and contamination problems by creating even more room for evaporation or contamination to occur.

Another problem with many traditional wipe containers occurs when the consumer does not realize that the container has not been closed correctly. If a lid is not closed properly the interface between the lid and container section will allow accelerated evaporation or contamination of the solution, potentially rendering the product useless for its intended purpose. A related problem is the need to manually deflect a portion of the lid to engage it with the container. This requires the use of both hands and also creates both closing and sealing problems.

To overcome the disadvantages and problems of existing wipe containers, it would be advantageous to provide an inexpensive and simple-to-use hermetic storage system capable of containing wipes that are at least partially saturated with a liquid solution in a hermetically sealed environment. The hermetic storage system may advantageously be sealed and opened without manual deflection of the container or lid. Also, it would be advantageous to provide an inexpensive simple-to-use hermetic storage system capable of providing a hermetically sealed environment which can be manufactured in one piece. It would also be desirable to provide an inexpensive simple-to-use hermetic storage system capable of providing an audible indicator once a hermetic seal has been established. It would further be advantageous to provide a hermetic storage system capable of supporting at least one partially saturated wipe in a container that is flexible to enable the hermetic storage system to be more suitably stored in places of limited size such as pockets, purses, briefcases, backpacks, vehicle storage compartments, diaper bags and the like. It would further be advantageous to provide a structure for supporting a flexible container in a manner sufficient to create a hermetic seal between the flexible container and the structure.

SUMMARY

A hermetic storage system for containing wipes is provided. The hermetic storage system includes a first member, a second member, and a flexible container configured for holding the wipes. As used herein when describing the container, "flexible" refers to a structure that does not substantially restrict the pliability of the container. For example, a flexible container is one that may be readily folded, crushed, bent, shaped, etc. without requiring substantial force from a user. The first member is coupled to an open end of the flexible container and defines an aperture. The first member and the second member may be engaged through a first connector and second connector. When engaged, the first member and the second member provide a hermetically sealed environment. As used herein "hermetic" and "hermetically" refer to an airtight or substantially airtight seal. For example, a substantially airtight seal may include a seal that retains at least 80% water weight over 28 days at 50° C. and 60% relative humidity. The second member may be impermeable, or it may surround an aperture through which wipes may pass. As used herein "impermeable" means without an aperture, opening, or other means for a substance to pass through the second member. The wipes may be at least partially saturated with a liquid solution or it may be impregnated with a substantially dry substance, which may include soaps or other surfactants that can be activated when contacted with water.

The first member may have the first connector and the second member may include the second connector. The first connector may surround an aperture. The first connector can include one of a groove and a key and the second connector may include the other one of the groove and the key. The groove desirably includes a first peripheral wall and a second peripheral wall. Preferably, at least one of the first peripheral wall and second peripheral wall is flexible. The first peripheral wall includes a protrusion and an indentation. The key is configured to engage the groove. Generally, the key includes a lip, and at least a portion of the key has a width greater than the distance between the protrusion and the second peripheral wall. The first connector and the second connector may be releasably engaged by engaging the key and groove. Once engaged, the key and groove provide a hermetic seal as the key is positioned between the first and second peripheral walls surrounding the groove, and is closely adjacent to at least one of the first and second peripheral wall. Preferably, the key is contacting at least one of the first and second peripheral walls. To further effect the seal and provide a latching mechanism, the indentation may be configured to receive the lip.

Also provided is a hermetic storage system for containing one or more wipes that includes a flexible container, a first member and a second member. The first member is coupled to an open end of the flexible container and includes a peripheral edge surrounding an aperture. The peripheral edge may extend outwardly from the first member. An example of the peripheral edge is the key, and the peripheral edge may also include a lip. The aperture may allow access to the wipes when they are contained therein. The second member may be configured to allow the user to selectively engage the second member with the first member. When the second member is releasably engaged with the first member, the seal formed between the first member and the second member provides a hermetically sealed environment for the wipes. Generally, the second member includes two walls which form a groove for releasable engagement with the peripheral edge. The groove is defined by a first peripheral wall and a second peripheral wall, wherein at least one of the first peripheral wall and the second peripheral wall is flexible. The first peripheral wall may have an indentation and a protrusion that defines a distance between the protrusion and the second peripheral wall that is less than the width of the peripheral edge (including lip, if any). The peripheral edge and groove form a continuous hermetic seal when the peripheral edge and groove are releasably engaged.

Additionally, provided is a hermetic storage system for containing wipes that includes a first member having a first and a second peripheral wall which define a groove. The first member is coupled to an open end of a flexible container. The groove surrounds an aperture which permits access to the wipes when within the flexible container. The hermetic storage system also includes a second member having a peripheral edge that includes a lip for releasable engagement with the groove. The first peripheral wall commonly includes an indentation and a protrusion that defines a distance between the protrusion and the second peripheral wall that is less than the width of the peripheral edge. At least one of the first peripheral wall and the second peripheral is flexible so that the lip may pass between the protrusion and the second peripheral wall and form a continuous hermetic seal when the peripheral edge and the groove are releasably engaged. Desirably, the first member and the second member are releasably engaged without manual deflection of either the first member or the second member. At least one of the first and second peripheral walls are preferably closely adjacent to the peripheral edge when the second member and the first member are in a releasably engaged, hermetically sealed position, and even more preferably at least one peripheral wall is contacting the peripheral edge.

In part, a hermetic storage system for containing wipes that includes a flexible containing means and a covering means for selectively enclosing the flexible container in a hermetically sealed position and an unsealed position is provided. The flexible containing means may be made of any flexible, impervious material. The flexible containing means may be in variety of shapes and configurations. For example, a common configuration includes cylindrical flexible containers having a single side wall extending from a base and forming an aperture opposite the base. Other configurations may include a flexible container with a plurality of flexible side walls hermetically coupled together and extending from a base and forming an aperture opposite the base. These flexible containers may be substantially rectangular, square or other polygonal and shaped containers configured for holding the wipes. Other containing means may include one or more side walls extending between a first base and a second base, wherein at least one aperture is located in the first base. The flexible containing means may further include a first member coupled to an open end of the flexible containing means and having one of a first and second connector, which may surround the aperture.

The covering means may be at least one second member configured to selectively enclose the flexible containing means by releasably engaging the at least one aperture included in the first member coupled to the open end of the flexible containing means. The covering means may generally have the same shape as the first member and be configured to enclose the flexible containing means. The covering means may include the other of the first and second connector, which engages the connector of the first member to provide a hermetic seal. The covering means may also include a third member. For example, the covering means may include a second member which is configured to engage the connector surrounding the aperture of the first member coupled to the flexible containing means. The second member may also include at least one of a first and second connector that surrounds a second aperture. A third member having the other one of the first and second connector may by used to engage the connector of the second member and provide a hermetic seal between the second and third members.

The first connector may include one of a groove and a key, and the second connector may be the other of the groove and key. Generally, the flexible containing means includes one of the groove and key and the covering means includes the other one of the groove and the key. The groove and key may be selectively engaged to provide a hermetic seal between the flexible containing means and covering means. The groove is defined by a first peripheral wall and a second peripheral wall. The first peripheral wall may have an indentation and a protrusion. The key may have a lip which can adjoin the indentation of the groove when in the releasably engaged position. The key (including the lip) commonly has a width greater than the distance between the first and second peripheral wall. Desirably, at least one of the first peripheral wall and the second peripheral wall is flexible to permit the key to pass between the protrusion and second peripheral wall without manually deflecting the second member or the first member. When engaged, the second peripheral wall is closely adjacent to the key, and more preferably, is contacting the key to provide the hermetic seal. The flexible containing means and covering means may have a plurality of grooves and keys corresponding to a plurality of apertures included therein to effect a hermetic seal.

The covering means can be coupled to or independent of the flexible containing means. When coupled, the flexible containing means and covering means may be integral with one another or attached to one another by an attachment means. The covering means may also be pivotally coupled to the flexible containing means. For example, the covering means may be coupled to the containing means by a living hinge or other known method of pivotally coupling the first member and the second member.

Also provided is a method for providing a hermetic storage system for wipes. Generally, the method includes providing a flexible container configured for holding the at least partially saturated wipes. The method further may include providing a first member and coupling the first member to an open end of the flexible container, the first member having a first connector surrounding an aperture. The method further may include providing a second member having a second connector. The second member may be impermeable or the second member may include at least one aperture. The first connector may have one of a groove and a key and the second connector may have the other one of the groove and the key. The groove preferably includes a first peripheral wall and a second peripheral wall and at least one of the first peripheral wall and the second peripheral wall is flexible. Generally, the first peripheral wall includes an indentation and a protrusion. The key has a width greater than the distance between the protrusion and the second peripheral wall. The first connector and the second connector may be releasably engaged to provide a hermetic seal. The method may further include inserting wipes within the flexible container. The wipes may be at least partially saturated with a liquid solution. Alternatively, the wipes may be impregnated with a substance having a relatively dry feel. Upon inserting the wipes, the second member may be engaged with the first member to provide a hermetic seal.

The hermetic storage system herein disclosed may also include a sealing member that can be used to cover the aperture used to access the wipes. The sealing member may be removed upon first use. The sealing member may also be resealable after removal. Examples of sealing members may include a foil or film, which may be constructed from plastic, metal, or laminates thereof. Other exemplary embodiments, apparent to those skilled in the art, may also include a hermetic storage system with more than two apertures wherein each aperture has a corresponding member configured to effect a hermetic seal in accordance with the key and groove configurations disclosed herein. For instance, the member may surround an additional aperture wherein the member is configured to releasably engage a lid or other member using the key and groove configuration described herein to create a hermetic seal.

A further understanding of the nature and advantages of the hermetic storage system disclosed herein may be realized by reference to the remaining portions of the specification and the drawings. It is to be understood that the invention is not limited in its application to the details of construction and the arrangements of components set forth in the following description or illustrated in the drawings.

DETAILED DESCRIPTION

With reference to all FIGURES, shown are the preferred embodiments of a hermetic storage system 41 in accordance with the present application. The hermetic storage system 41 may contain wipes. The wipes may be at least partially saturated with a liquid solution. The liquid solution may be an aqueous, non-aqueous, volatile or non-volatile solution. Such solutions may be used for moisturizing and/or cleansing. Alternatively, the wipes may be impregnated with a substance that is relatively dry. For example, the wipes may be impregnated with surfactants or with paraffin.

Figure 1:
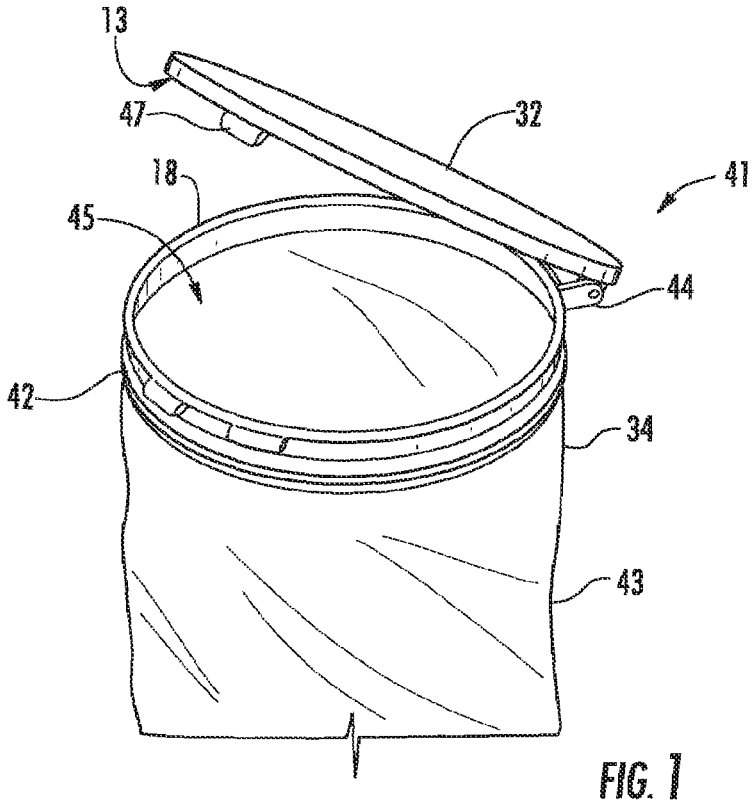
FIG. 1 is a perspective view of a hermetic storage system in an open configuration in accordance with the teachings of the present application.

Referring to FIG. 1, the hermetic storage system 41 generally includes a flexible container 43, a first member 42, and a second member 32. The flexible container 43 includes a open first end 34 and a closed second end 36. The flexible container 43 surrounds an aperture 45 and may be configured to hold one or more wipes. The flexible container 43 is preferably made from an impervious, flexible material including, but not limited to, Polypropylene (PP), Low Density Polyethylene (LDPE), Linear Low-Density Polyethylene (LLDPE), Medium Density Polyethylene (MDPE), High Density Polyethylene (HDPE), and Ethylene Vinyl Acetate (EVA).

As used herein "impervious" refers to a material that is substantially incapable of being undesirably penetrated by a substance being contained by the flexible container or by a potential contaminating substance existing outside the flexible container. The impervious material may be configured to minimize the penetration of a variety of substances including, but not limited to, aqueous substances, alcohols, solvents, surfactants, fragrances, silicones, etc. As can be appreciated, other suitable flexible materials, including composites, can be used where specific barrier properties are required for the substance that is being contained. According to various alternative embodiments, the flexible material may elastic properties enabling the flexible container to conform to the wipes disposed within the container.

According to one embodiment, the flexible container 43 may be a seamless flexible container that surrounds the aperture 45 and is configured to hold one or more wipes. According to another embodiment, the flexible container 43 may be a flexible container made of a plurality of flexible walls that are hermetically coupled together to surround the aperture 45 and configured to hold one or more wipes. The plurality of flexible walls may be hermetically coupled together through the use of adhesives, heat sealing, welding, or any other generally known method for providing a hermetic seal. According to a further embodiment, the flexible container 43 may be made of a single sheet of flexible material that is manipulated to define the aperture 45. For example, a flexible container may be formed by manipulating a single sheet of flexible material into a cylindrical container having a circular cross section and hermetically coupling the sheet together. As can be appreciated, the flexible container 43 may be configured in a wide variety of shapes to accommodate the wipes including, but not limited to, rectangular, polygonal, triangular, octagonal, spherical, etc.

The first member 42 may be configured to couple to the open first end 34 of the flexible container 43. The first member 42 may be permanently coupled to the flexible container 43 or may be detachably coupled to the flexible container 43. The first member 42 is coupled to the flexible container 43 in a manner sufficient to maintain a hermetic seal between the flexible container 43 and the first member 42. The flexible container 43 may be coupled to the first member 42 using mechanical fasteners, adhesive, heat sealing, welding, or any other generally known method of coupling. According to one embodiment, the first member 42 may be a flange or a collar that defines an aperture 45 as illustrated in FIG. 1. In another embodiment, the first member may be a flange or collar that includes a base or a platform that defines an aperture 45.

Figure 5:
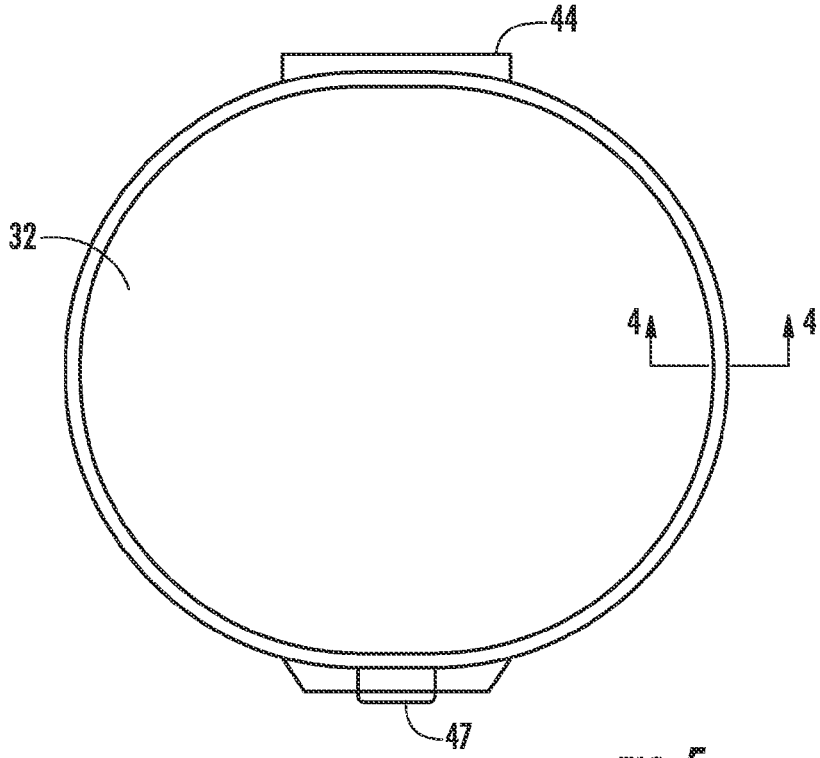
FIG. 5 is a plan view of the hermetic storage system in a releasably engaged position in accordance with the teachings of the present application.
Figure 6:
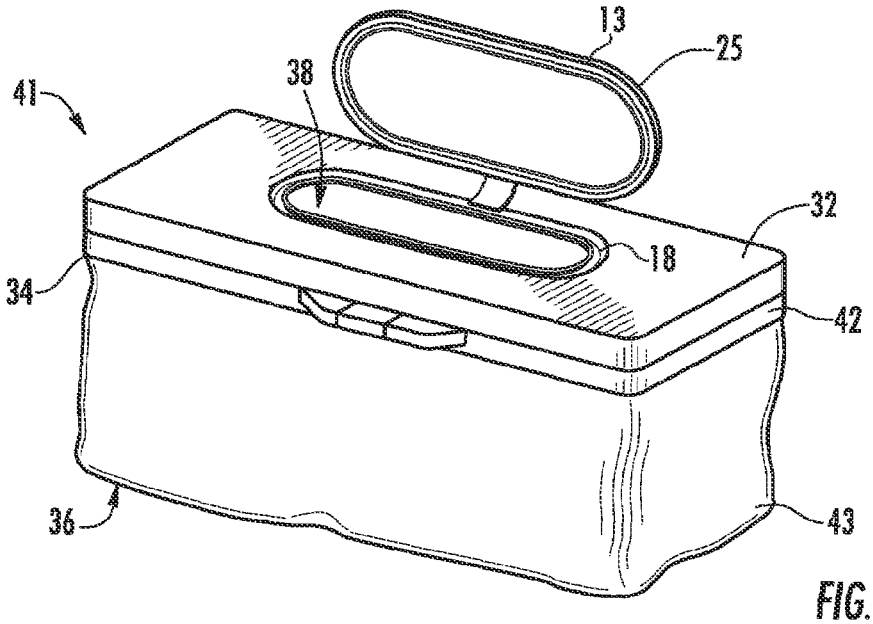
FIG. 6 is a perspective view of an alternative embodiment of a hermetic storage system in an open position in accordance with the teachings of the present application.
Figure 7:
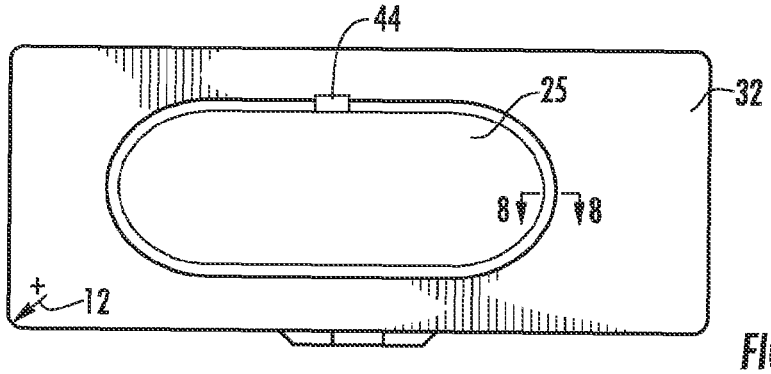
FIG. 7 is a plan view of the hermetic storage system shown in FIG. 6 in a releasably engaged position.

The second member 32 may be configured to cover the aperture 45 and enclose the wipes when within the first member 42 and the flexible container 43. The second member 32 may be independent from the first member 42 or coupled with the first member 42. The second member 32 can be coupled to the first member 42 by being integral with the first member 42 or attached to the first member 42 through an attaching means 44. In the preferred embodiment, the second member 32 may be pivotally coupled to the first member 42 by a living hinge or other equivalent methods or pivotally coupling mechanisms known to those skilled in the art. The second member 32 may be impermeable as shown in FIGS. 1 and 5 or may include at least one aperture 38 as shown in FIGS. 6-7.

The hermetic storage system 41 may further include an opening mechanism 47 to facilitate engaging and disengaging the second member 32 with the first member 42. The opening mechanism 47 may be a latch, lever, switch, handle, or other means to facilitate engagement or disengagement of the second member 32 and the first member 42. The opening mechanism 47 may be coupled to the first member 42 or the second member 32. For example, a tab-like design may be utilized to allow the consumer to disengage the second member 32 from the first member 42 using only one hand by exerting opposite forces on the first member 42 and second member 32. Hermetic storage system 41 may also include a latching or locking mechanism, however, a latching or locking mechanism is unnecessary to ensure the second member 32 and the first member 42 remain configured in a releasably engaged position. Additionally, the hermetic storage system 41 may also include an element for keeping the second member 32 and the first member 42 configured in an open position once opened by the consumer.

Figure 2:
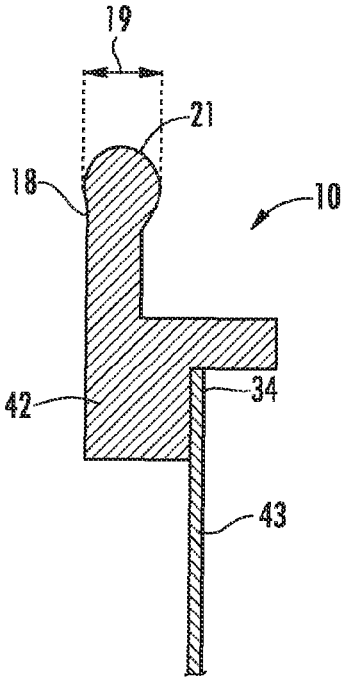
FIG. 2 is a cross-sectional view of a connector in the form of a key in accordance with the teachings of the present application.
Figure 3:
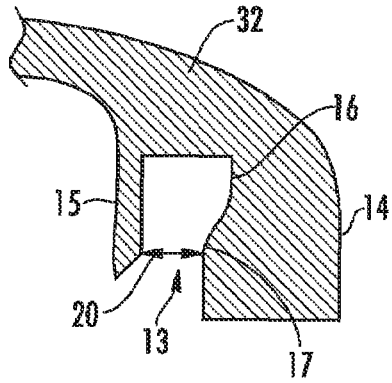
FIG. 3 is a cross-sectional view of a connector in the form of a groove in accordance with the teachings of the present application.
Figure 4:
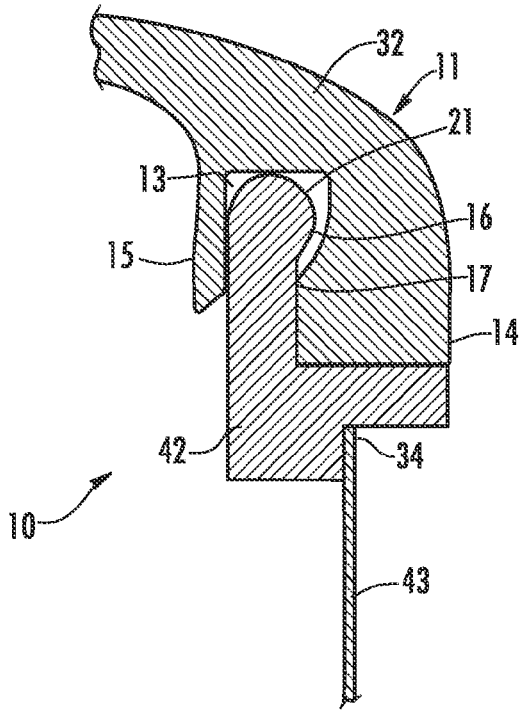
FIG. 4 is a cross-sectional view of the hermetic seal that is created when the key and groove are releasably engaged as shown in FIG. 5.

To establish a hermetically sealed environment, the first member 42 may provide a first connector 10 or a second connector 11 as most clearly shown in FIGS. 2-4. The first connector 10 may be in the form of a peripheral edge, such as a key 18 as depicted in FIG. 2. In other embodiments, the first connector 10 may also be in the form of a groove 13 as depicted in FIG. 3. The second connector 11 may be the other of the key 18 or groove 13. The key 18 may be configured to releasably engage the groove 13 when the second member 32 and the first member 42 are placed in the closed position. When engaged, the key 18 and groove 13 form a hermetic seal continuously about the aperture 45 as depicted in FIG. 4. The first member 42 may include the key 18 and the second member 32 the groove 13 to effect the seal. In an alternative embodiment the first member 42 may provide the groove 13 and the second member 32 may provide the key 18.

In FIG. 2, the first connector 10 in the form of the key 18 is shown. The key 18 may include a lip 21, which can be located at the distal end of key 18 as shown or intermediate the key 18. A portion of the key 18 has a width 19. Generally the width 19 can be provided by including the lip 21. The lip 21 may include a rounded curvilinear edge extending from the key 18 as shown in FIG. 2. Alternatively the lip 21 may be comprised of a section with linear edges to form triangular, rectangular, or other polygonal shape, or may be configured in a variety of shapes combining both linear and nonlinear edges. In another embodiment the lip 21 may be formed by removing a portion of the key between its distal edge and the first member 42 or the second member 32 to which the key 18 is coupled resulting in a lip 21 that does not bulge outward from the key 18.

Referring to FIG. 3, the second connector 11 in the form of the groove 13 is shown. The groove 13 is defined by a first peripheral wall 14 and a second peripheral wall 15. The first peripheral wall 14 may include an indentation 16 and a protrusion 17. The protrusion 17 and second peripheral wall 15 define a distance 20. Generally, the distance 20 is no greater than the width 19 of the key 18, and in the preferred embodiment the distance 20 is slightly less than the width 19 of the key 18. Most desirably, the distance 20 is determined between the protrusion 17 and the second peripheral wall 15 of the groove 13. In the preferred embodiment, the second peripheral wall 15 is flexible to allow the key 18 to releasably engage the groove 13. A flexible second peripheral wall also facilitates engagement of the key 18 and groove 13 without manual deflection of the second member 32 or the first member 42. The second peripheral wall 15 may also include a chamfered edge to facilitate engagement of the key 18. In alternative embodiments either one or both of the first peripheral wall 14 and second peripheral wall 15 may be flexible to allow the key 18 to releasably engage the groove 13.

FIG. 4 shows a cross-sectional view of the hermetic seal when the first connector 10 and second connector 11 are releasably engaged as illustrated in FIG. 5. The first connector 10 is shown including the key 18 and the second connector 11 is shown including the groove 13, however, the first connector 10 may include the groove 13 and the second connector 11 may include the key 18. When the hermetic storage system 41 is placed in the closed position the second connector 11 becomes releasably engaged with the first connector 10. During engagement, the lip 21 of the key 18 passes between the first peripheral wall 14 and second peripheral wall 15. The second peripheral wall 15 is flexible to facilitate releasable engagement of the key 18 and the groove 13 by allowing the lip 21 of the key 18 to pass between the protrusion 17 and the second peripheral wall 15. Once the key 18 is releasably engaged with the groove 13, the lip 21 may be adjacent to the indentation 16 and the key 18 may be closely adjacent to at least one of the first peripheral wall 14 and second peripheral wall 15 to effect the hermetic seal between the first member 42 and the second member 32. Desirably, the key 18 is in contact with at least one of the first peripheral wall 14 and second peripheral wall 15. When the key 18 and the groove 13 are releasably engaged, the peripheral wall 15 and key 18 interact to provide a hermetic seal and hermetic environment for the wipes. The lip 21 and protrusion 17 also interact to maintain the hermetic storage system 41 in a releasably engaged configuration. Although the preferred embodiment is shown, variations are possible without departing from the spirit and scope of the specification and claims. For instance the second peripheral wall 15 may include the indentation 16 and protrusion 17. Alternatively, the lip 21 may be positioned such that it is closely adjacent to the indentation 16 when the first connector 10 and second connector 11 are releasably engaged. A number of different configurations that include the key 18, groove 13, indentation 16, protrusion 17, lip 21, or a plurality of one or more of the elements previously described may be conceived to achieve the hermetic seal without departing from the spirit and scope of the specification and claims.

FIGS. 6-7 illustrate a hermetic storage system 41 having a generally rectangular cross section. Radius 12 is configured such that when the second member 32 is engaged with the first member 42 the hermetic seal minimizes evaporation or contamination of the contents in hermetic storage system 41. For example, in one embodiment, radius 12 may be no less than 0.2 inches, and more preferably no less than 0.4 inches. The radius 12 desirably is of a length to permit the second member 32 and the first member 42 to engage in the closed position, while maintaining the hermetic seal.

Figure 8:
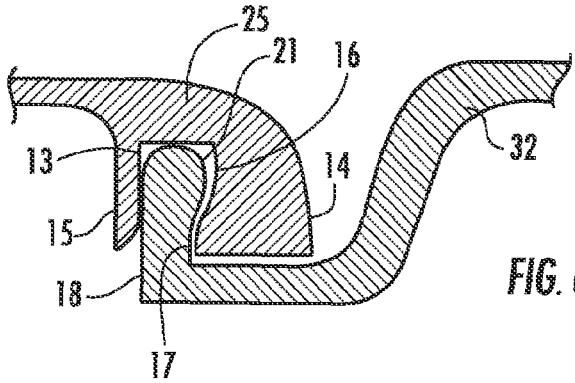
FIG. 8 is a cross-sectional view of the hermetic seal that is created when the second member and third member are releasably engaged as shown in FIG. 7.

Referring to FIGS. 6, 7 and 8, an alternative embodiment of a hermetic storage system 41 having a flexible container 43 having an open first end 34 and a closed second end 36, a first member 42 coupled to the open first end 34 and defining an aperture 45, a second member 32 covering the aperture 45 and having a second aperture 38, and a third member 25 covering the second aperture 38 is shown. The second member 32 may be configured with a first connector or second connector as described in the preferred embodiment and releasably engaged with the first member 42 to provide a hermetic seal, or it may be snap-fit with the first member 42 or welded with the first member 42 to provide a hermetic seal. The second member 32 may be coupled to the first member 42 or may be independent from the first member 42.

Generally, the second member 32 includes one of the key 18 and the groove 13 which surrounds the second aperture 38. The third member 25 includes the other one of the key 18 and the groove 13. The third member 25 and second member 32 may be selectively placed in the closed position to releasably engage the key 18 and groove 13 to effect a hermetic seal as shown in FIGS. 7-8. In FIG. 8, the third member 25 including a groove 13 and the second member 32 including a key 18 are shown. The hermetic storage system 41 may include a plurality of apertures and corresponding cover members wherein each associated aperture and cover member is configured with the key 18 and groove 13 configuration disclosed herein to provide a hermetically sealed environment for the at least partially saturated wipes without departing from the spirit or scope of the specification and claims. For instance, the second member 32 of the hermetic storage system 41 shown in FIGS. 1-5 may surround an aperture 45 as shown in FIGS. 6-8 or, alternatively, the second member 32 of FIGS. 6-8 may be permanently connected to the first member 42 by weld, snap-fit, integrally formed, or other similar sort of sealing process or mechanism known to those skilled in the art.

Referring to FIGS. 9 through 14, another alternative embodiment of a hermetic storage system 41 is shown. Hermetic storage system 41 generally includes a flexible container 43, a first member 42, a second member 32, and a third member 25. In such an embodiment, at least a portion of flexible container 43 is disposed between first member 42 and second member 32 in a manner sufficient to form and maintain a hermetic seal between flexible container 43 and at least one of first member 42 and second member 32. According to a preferred embodiment, as detailed below, a portion of flexible container 43 is compressed (e.g., pinched, squeezed, pressed, etc.) between first member 42 and second member 32 to form and maintain a hermetic seal.

Figure 9:
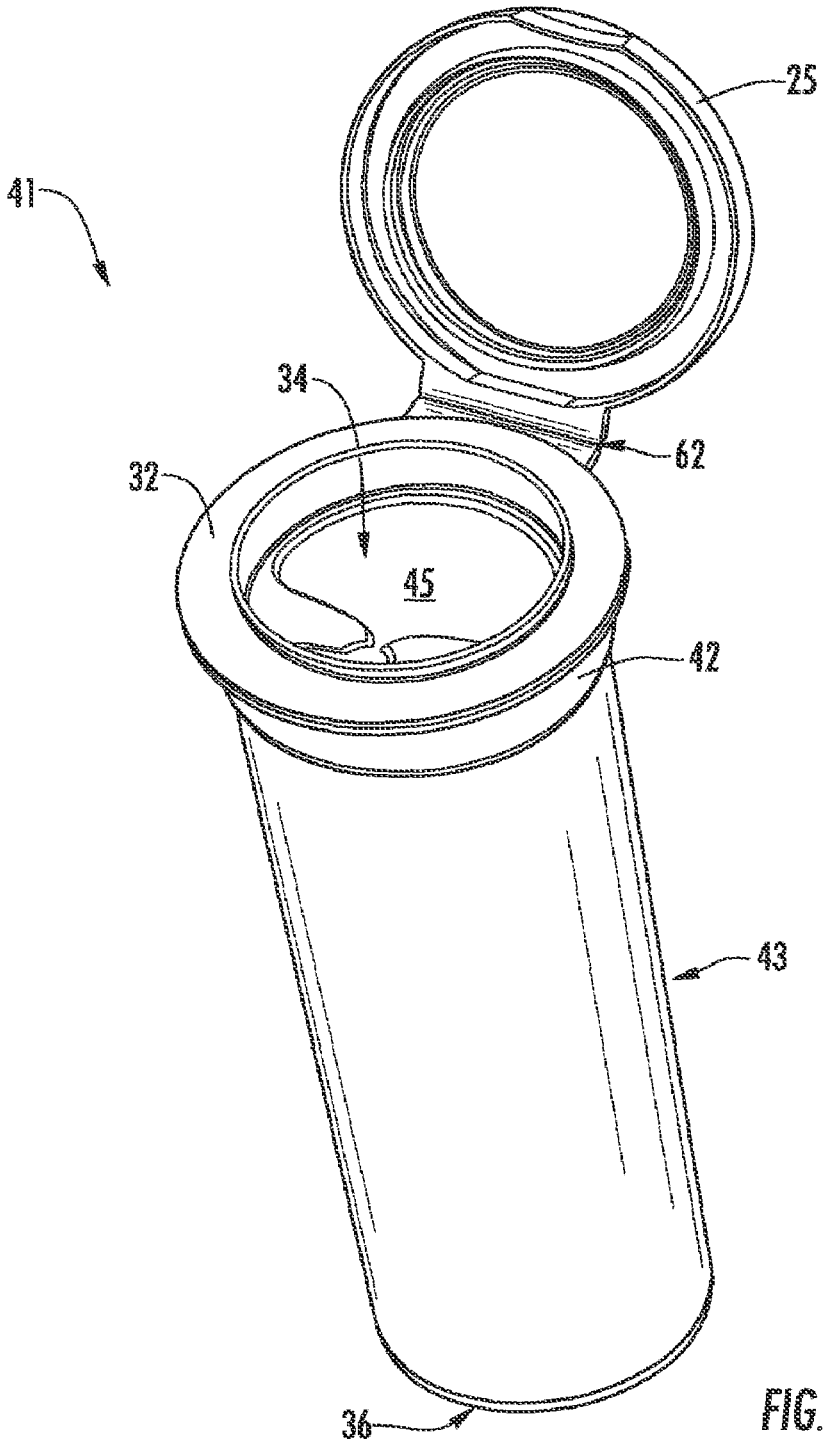
FIG. 9 is a perspective view of another embodiment of a hermetic storage system in an open configuration in accordance with the teachings of the present application.
Figure 10:
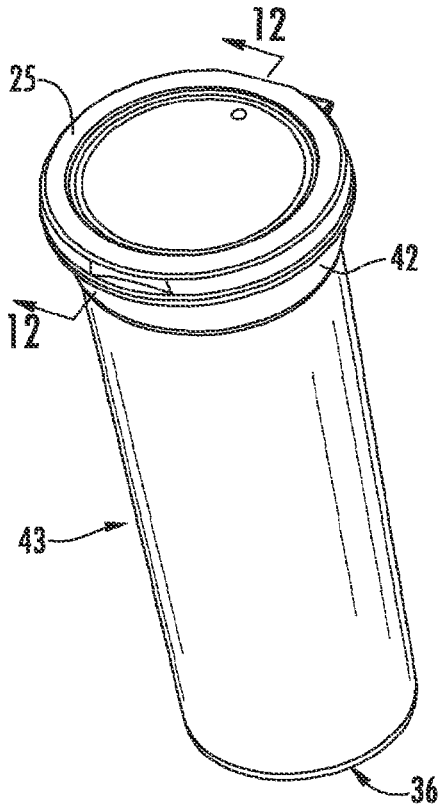
FIG. 10 is a perspective view of the hermetic storage system illustrated in FIG. 9 in a closed configuration.

Referring particularly to FIGS. 9 and 10, flexible container 43 surrounds an aperture 45 and may be configured to hold one or more wipes, and generally includes a body portion 49 extending between an open first end 34 and a closed second end 36. Open end 34 of flexible container 43 includes a rim or flange 50 (shown in FIGS. 13 and 14) that preferably extends along the entire circumference of the open end. Flange 50 is shown having a thickness 51 that is greater than the thickness of body portion 49. In an alternative embodiment, flange 50 may have a thickness that is substantially the same as the thickness of body portion 49. Flange 50 may be made of same material as body portion 49, or alternatively, may be made of a different material (e.g., a more rigid material, a more compressible material, etc.). As mentioned earlier, flexible container 43 may be made of any of a variety of flexible materials. According to a particularly preferred embodiment, flexible container 43 is made of LDPE and/or LLDPE.

Figure 11:
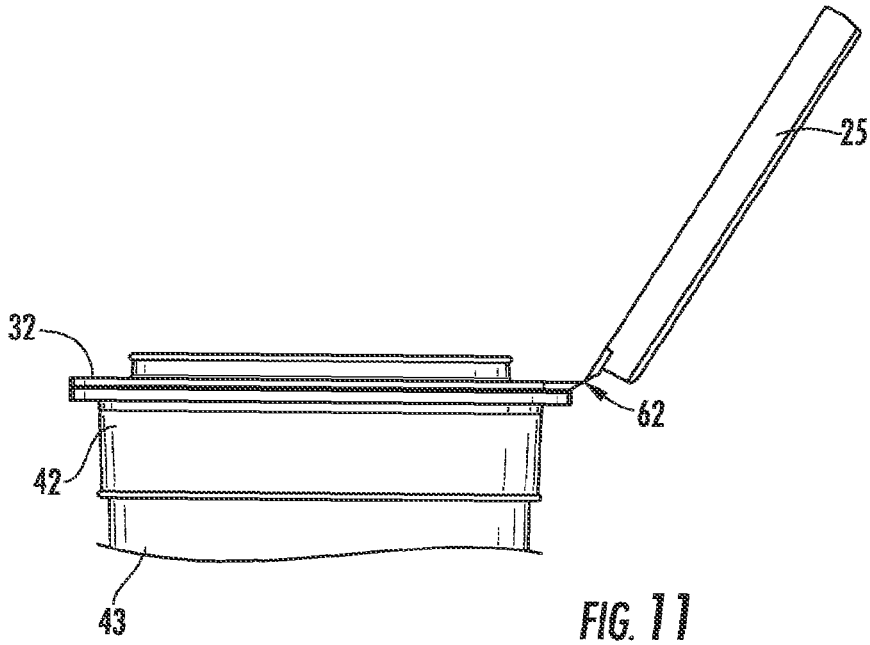
FIG. 11 is a partial side view of the hermetic storage system illustrated in FIG. 9 in the open position.

FIG. 11 shows a partial side view of hermetic storage system 41 when third member 25 is in an open position relative to second member 32. Third member 25 is configured to releasably engage second member 32 and move between an open position and a closed position (shown in FIG. 10). In the closed position, third member 25 covers aperture 45 defined by flexible container 43. Third member 25 is shown as being movably coupled to second member 32 at an interface, shown as a living hinge 62. As can be appreciated, third member 25 may be movably coupled to second member in a variety of ways, or alternatively, may be independent from second member 32.

For the sake of brevity, it is noted that for such an embodiment, third member 25 may be configured with one of a first connector and a second connector as described in the preferred embodiment, and be configured to be releasably engaged with the second member 32 having the other of the first connector and the second connector to provide a hermetic seal between third member 25 and second member 32. According to the particular embodiment illustrated, with reference to FIG. 12, second member 32 includes a key 18 having a lip 21 that is configured to releasably engage a groove provided in third member 25. The groove is defined by a first peripheral wall 14 and a second peripheral wall 15. The first peripheral wall 14 includes an indentation 16 and a protrusion 17. The distance between protrusion 17 and second peripheral wall 14 is slightly less than the width of key 18.

Figure 12:
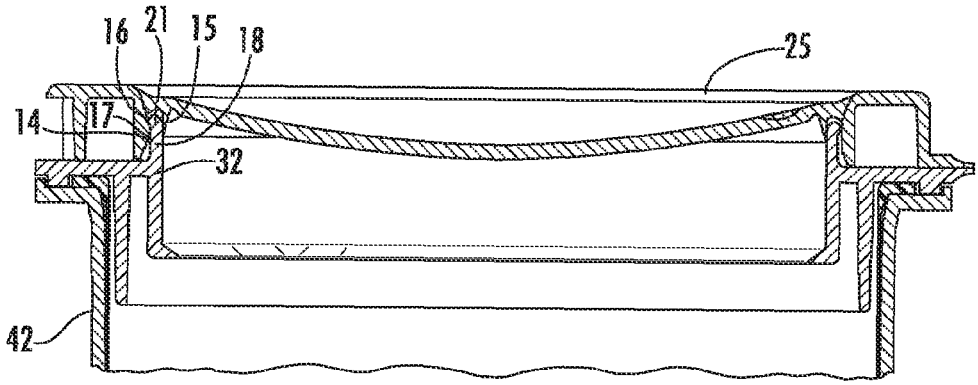
FIG. 12 is a partial cross-sectional view of the hermetic storage system taken along the line 12-12 in FIG. 10.

FIG. 12 shows a partial cross-sectional view of hermetic storage system 41 when first member 42 is engaged with second member 32 and third member 25 is engaged with second member 32. First member 42 and second member 32 are configured to be coupled together in a manner sufficient to retain flexible container 43 and/or in a manner sufficient to hide or otherwise conceal the coupling of flexible container 43 to at least one of first member 42 and second member 32. As can be appreciated, first member 42 and second member 32 may be coupled together using any of a variety of generally known techniques including, but not limited to, mechanical fasteners, adhesives, snap-fit, press-fit, and/or any appropriate welding process. Such coupling may be intended to be relatively permanent in nature, or alternatively may be intended to be relatively movable or releasable in nature. In addition, first member 42 and second member 32 may be directly coupled, or alternatively may be indirectly coupled.

Figure 13:
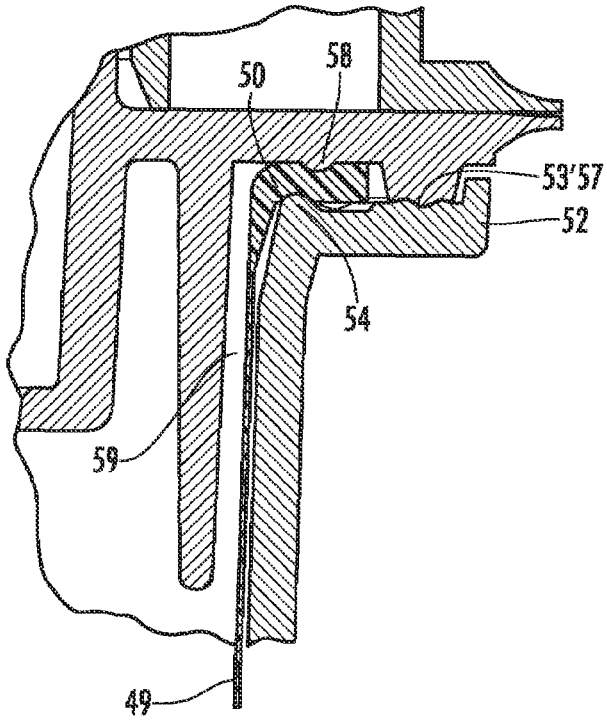
FIG. 13 is a detailed view of a portion of the hermetic storage system illustrated in FIG. 12.
Figure 14:
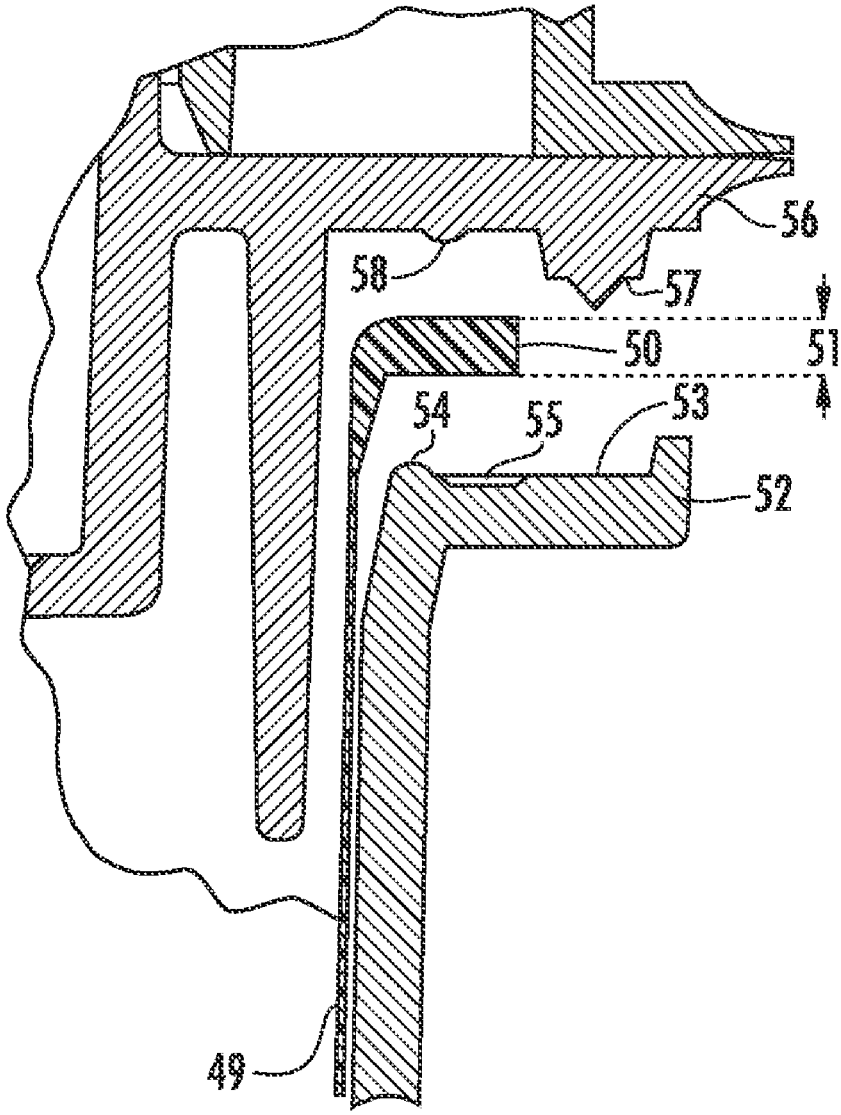
FIG. 14 is an exploded detailed view of a portion of the hermetic storage system illustrated in FIG. 13.

Referring to FIGS. 13 and 14, first member 42 is shown as an annular sleeve designed to be positioned adjacent to the outer (e.g., exterior, exposed, etc.) surface of flexible container 43. First member 42 includes a platform or base, shown as a flange 52. Flange 52 provides a structure for coupling first member 42 to second member 32 and/or for coupling flexible container 43 between the first member and the second member. According to a preferred embodiment, flange 52 includes an abutment surface 53 designed to engage a corresponding portion on second member 32. First member 42 further includes a projection (e.g., crush members, etc.), shown as a rib 54, for engaging a portion of flexible container 43, preferably flange 50, and optionally includes a groove or recess 55 for receiving a portion of flexible container 43 and/or a projection on second member 32.

Second member 32 is shown as a collar designed to be positioned adjacent to the inner surface of flexible container 43. As mentioned above, second member includes one of a first connector and a second connector for releasably engaging third member 25. Second member is shown to further include a flange 56 having an abutment surface 57 configured to engage abutment surface 53 of first member 42, and at least one projection, shown as a rib 58, for engaging a portion of flexible container 43, preferably flange 50. Rib 58 preferably extends continuously around flange 56, but alternatively may be intermittently positioned along flange 56.

As can be appreciated, first member 42 and/or second member 32 may have any number of projections and/or recesses for engaging flexible container 43. In embodiments not illustrated, such projections and/or recesses may be provided only one of first member 42 and second member 32. As illustrated in FIGS. 12 through 14, ribs 54, 58 are concentric ribs having cross-sections that are substantially semi-circular in shaped. As can be appreciated, ribs 54, 58 may cross-sections with any shape suitable for engaging flexible container 43 including, but not limited to, triangular, rectangular, polygonal, etc.

Referring particularly to FIG. 13, when abutment surfaces 53, 57 are aligned, a groove (e.g., channel, cavity, etc.), shown as a slot 59, is formed between first member 42 and second member 32. Slot 59 is configured to receive a portion of flexible container 43. According to a preferred embodiment, flange 50 of flexible container 43 is disposed between first member 42 and second member 32 before abutment surface 53 engages abutment surface 57. In this manner, rib 54 and rib 58 will compress flange 50 against opposing portions of first member 42 and second member 32 when abutment surface 53 engages abutment surface 57. While in this position, first member 42 can be coupled to second member 32 to secure and retain flexible container 43 thereby forming and maintaining a hermetic seal by the flexible container and the members. According to a particularly preferred embodiment, first member 42 is coupled second member 32 by ultrasonically welding flanges 52, 56 at abutment surfaces 53, 57 respectively.

As can be appreciated, such a configuration may advantageously provide a structure capable of forming a hermetic seal between a flexible container and a member when the flexible container cannot practically be coupled to the member or direct coupling is otherwise undesired. For example, flexible container 43 may be made of a material that cannot be welding to the material of second member 32. The addition of first member 42 would enable a hermetic seal to be formed without having to weld flexible container 43 to second member 32.

A method of manufacturing hermetic storage system 41, as illustrated in FIGS. 9 through 14, includes the steps of providing a flexible container having an open end and a body portion defining an aperture configured to hold at least one wipe, positioning the open end of the flexible container between a first and second member, moving the first and second members in a direction that compresses the flexible material between the first and second members; coupling the first and second member together in a manner sufficient to form and maintain a hermetic seal between the flexible container and the first and second members. According to a preferred embodiment, the first and second members each include a flange that are coupled together by an ultrasonic welding process.

An alternative method of manufacturing hermetic storage system 41, as illustrated in FIGS. 9 through 14, includes the steps of providing a flexible container having an open end and a body portion defining an aperture configured to hold at least one wipe, coupling the flexible container near the open to one of a first member and a second member in a manner sufficient to form and maintain a hermetic seal between the flexible container and the first or second member, coupling the first and second member together in a manner that conceals the coupling of the flexible container. According to a preferred embodiment, the first and second members each include a flange that are coupled together by an ultrasonic welding process.

Although the invention has been described with reference to the preferred embodiments illustrated in the attached drawing figures, it is noted that equivalents may be employed and modifications, variations, or substitutions may be made herein without departing from the scope or spirit of the invention as recited in the specification and claims. Additionally, it will be understood by those skilled in the art that although the hermetic storage system disclosed herein has been described for use with the wipes, it may also be used with similar natural and synthetic products susceptible to evaporation or contamination which include but are not limited to: swabs, cloths, pads, cloth-like, chamois, porous materials, and any equivalents thereof. Likewise, it will be understood by those skilled in the art that any one of the aforementioned items or their equivalents may be at least partially saturated or impregnated with any number of substances susceptible to contamination or evaporation including but not limited to: saline solutions, alcohol, hydrocarbon and aqueous solutions, polishes, waxes, nonconductive and anti-static substances, resins, and other substances intended for a variety of uses including but not limited to cleaning, disinfecting, antibacterial, germicidal, anti-microbial, moisturizing and conditioning, dissolving and equivalents thereof.

Further, it will be understood by those skilled in the art that the hermetic storage system disclosed herein will be useful for storing materials that are not at least partially saturated or impregnated with one or more substances but are free from such substances where to be used effectively the materials must remain free from contamination or moisture. For instance, the hermetic storage system disclosed herein would be useful for storing various clean, at least partially sterilized and dry items to prevent contaminants and moisture from entering.

What is claimed is:

1. A hermetic storage system for containing wipes comprising:

a flexible container configured for holding the wipes, the flexible container including a body portion extending between an open first end and a closed second end, the body portion having an outer surface defining an exterior of the hermetic storage system;

a first member;

a second member coupled to the first member and having a first connector surrounding an aperture; and a third member having a second connector;

wherein the flexible container is disposed between the first member and the second member;

wherein the first connector includes one of a groove and a key and the second connector includes the other one of the groove and the key;

wherein the groove includes a first peripheral wall and a second peripheral wall, at least one of the first peripheral wall and the second peripheral wall being flexible and wherein the first peripheral wall includes an indentation and a protrusion;

wherein the key has a width greater than the distance between the protrusion and the second peripheral wall; and wherein the first connector and the second connector may be releasably engaged to provide a hermetic seal.

2. The hermetic storage system of claim 1, wherein the key includes a lip.

3. The hermetic storage system of claim 2, wherein the indentation is adjacent to said lip when said key is engaged with said groove.

4. The hermetic storage system of claim 2, wherein the key and the second peripheral wall are closely adjacent to effect the hermetic seal.

5. The hermetic storage system of claim 1, wherein one of the first peripheral wall and the second peripheral is configured to flex in response to the key passing between the protrusion and the second peripheral wall without manual deflection of either the first or second peripheral wall.

6. The hermetic storage system of claim 5, wherein the second peripheral wall is configured to guide the key between the protrusion and the second peripheral wall as the third member and the second member are releasably engaged.

7. The hermetic storage system of claim 1, wherein the third member is pivotally coupled to the second member.

8. The hermetic storage system of claim 1, wherein the third member is independent from the second member.

9. The hermetic storage system of claim 1, wherein the body portion of the flexible container includes a cylindrical side wall extending from the closed second end, wherein the side wall surrounds the aperture.

10. The hermetic storage system of claim 1, wherein the body portion of the flexible container includes at least two side walls hermetically coupled together and extending from the closed second end, wherein the side walls surround the aperture.

11. The hermetic storage system of claim 1, wherein at least one of the first member and the second member includes a rib configured to engage the flexible container.

12. The hermetic storage system of claim 11, wherein the rib compresses the flexible container to form a continuous hermetic seal.

13. The hermetic storage system of claim 11, wherein the flexible container further includes a flange near the open first end.

14. The hermetic storage system of claim 13, wherein the flange has a thickness greater than the body portion of the flexible container.

15. The hermetic storage system of claim 13, wherein the rib compresses the flange to form a continuous hermetic seal.

16. The hermetic storage system of claim 11, wherein the first member includes a first abutment surface and the second member includes a corresponding second abutment surface.

17. The hermetic storage system of claim 16, wherein the first abutment surface is coupled to the second abutment surface.

18. The hermetic storage system of claim 11, wherein the first member includes a first rib and the second member includes a second rib.

19. The hermetic storage system of claim 18, wherein the first rib is concentric with the second rib.

20. The hermetic storage system of claim 1, wherein the flexible container is hermetically coupled to the second member.

21. The hermetic storage system of claim 1, wherein the flexible container is permanently coupled between the first member and the second member.

22. The hermetic storage system of claim 1, wherein the flexible container is releasably coupled between the first member and the second member.

23. The hermetic storage system of claim 1, wherein the first connector and second connector form a continuous hermetic seal when releasably engaged.

24. The hermetic storage system of claim 1, wherein the flexible container is made of at least one of a Polypropylene (PP), a Low-Density Polyethylene, or a Linear Low-Density Polyethylene (LLDPE).

25. The hermetic storage system of claim 1, wherein the flexible container is a composite material.

26. A hermetic storage system for containing wipes comprising:

a flexible container configured for holding the wipes, the flexible container including a body portion extending between an open first end and a closed second end, the body portion having an outer surface defining an exterior of the hermetic storage system;

a first member positioned adjacent to at least one of an outer surface of the flexible container and an inner surface of the flexible container and having a first interface portion;

a second member coupled to the first member and positioned adjacent to the other of the outer surface of the flexible container and the inner surface of the flexible container and having a second interface portion and a first connector; and an impermeable third member having a second connector for releasably engaging the first connector to form a hermetic seal;

wherein the first interface portion and second interface portion are configured to engage the flexible container in a manner sufficient to support the flexible container.

27. The hermetic storage system of claim 26, wherein the flexible container further comprises a flange near the open first end.

28. The hermetic storage system of claim 27, wherein the flange has a thickness greater than the thickness of the body portion.

29. The hermetic storage system of claim 28, wherein the flange is compressed between the first interface portion and the second interface portion.

30. The hermetic storage system of claim 26, wherein the first interface portion includes at least one of a projection and a recess.

31. The hermetic storage system of claim 26, wherein the second interface portion includes at least one of a projection and a recess.

32. The hermetic storage system of claim 26, wherein at least one of first interface portion and second interface portion includes a projection configured to engage the flexible container.

33. The hermetic storage system of claim 32, wherein first interface portion includes a first projection and second interface portion includes a second projection.

34. The hermetic storage system of claim 33, wherein the first projection and the second projection are concentrically aligned.

35. The hermetic storage system of claim 34, wherein the first and second projections are configured to compress the flexible container.

36. The hermetic storage system of claim 35, wherein the first and second projection form a hermetic seal with the flexible container.

37. The hermetic storage system of claim 32, wherein the projection has a semi-circular cross section.

38. The hermetic storage system of claim 26, wherein the first member includes a first flange and the second member includes a second flange.

39. The hermetic storage system of claim 38, wherein the first flange includes a first abutment surface and the second flange includes a second abutment surface.

40. The hermetic storage system of claim 39, wherein the first abutment surface engages the second abutment surface.

41. The hermetic storage system of claim 40, wherein the first abutment surface is ultrasonically welded to the second abutment surface.

42. A hermetic storage system for containing wipes comprising:

a flexible container configured for holding the wipes, the flexible container including a body portion extending between an open first end and a closed second end, the body portion having an outer surface defining an exterior of the hermetic storage system;

a sleeve provided at the outer surface of the body portion near the open first end;

a collar provided at an inner surface of the body portion near the open first end; and a cover coupled to the collar and moveable between an open position and a closed position, the collar and the cover providing a first hermetic seal when the cover is in the closed position, wherein the flexible container is compressed between the sleeve and the collar to provide a second hermetic seal.

43. The hermetic storage system of claim 42, wherein the sleeve is an annular member and the flexible container has a substantially circular cross section.

44. The hermetic storage system of claim 42, wherein the open first end of the flexible container has an area of increased thickness relative to the body portion.

45. The hermetic storage system of claim 44, wherein the area of increased thickness is engaged by the sleeve and the collar to compress the flexible container between the sleeve and the collar.

46. The hermetic storage system of claim 45, wherein the area of increased thickness extends continuously around the circumference of the open first end.

47. The hermetic storage system of claim 42, wherein the collar has a first portion coupled directly to the flexible container and a second portion coupled directly to the collar.

48. The hermetic storage system of claim 47, wherein the collar includes a rib at the first portion for compressing the flexible container against the sleeve.

* * * * *

UNITED STATES PATENT AND TRADEMARK OFFICE

CERTIFICATE OF CORRECTION

PATENT NO. : 7,546,930 B2
APPLICATION NO. : 10/916019
DATED : June 16, 2009
INVENTOR(S) : Banik et al.

It is certified that error appears in the above-identified patent and that said Letters Patent is hereby corrected as shown below:

On the title page,

[*] Notice: Subject to any disclaimer, the term of this patent is extended or adjusted under 35 USC 154(b) by (689) days Delete the phrase "by 689 days" and insert -- by 1,216 days --

Signed and Sealed this

Sixth Day of April, 2010

David J. Kappos

David J. Kappos
*Director of the United States Patent and Trademark Office*